United States Patent [19]

Kolbach et al.

[11] 4,189,896

[45] Feb. 26, 1980

[54] LIQUID IMPREGNATING SYSTEM

[75] Inventors: Charles G. Kolbach, Media, Pa.; Edward M. Niedziejko, Wilmington, Del.; Joseph P. Rizzo, Lester, Pa.

[73] Assignee: Scott Paper Company, Philadelphia, Pa.

[21] Appl. No.: 936,863

[22] Filed: Aug. 25, 1978

[51] Int. Cl.[2] ..... B65B 3/00; B65B 1/20

[52] U.S. Cl. ..... 53/431; 53/436; 53/474; 53/527; 53/239; 141/12; 141/70; 100/73; 118/44; 427/300

[58] Field of Search ..... 53/431, 436, 474, 239, 53/527; 141/70, 12, 374, 392; 28/289; 100/73; 118/44; 427/300

[56] References Cited

U.S. PATENT DOCUMENTS

| | | | |
|---|---|---|---|
| 2,102,089 | 12/1937 | Perrin | 427/300 |
| 3,618,283 | 11/1971 | Moore et al. | 53/431 |

*Primary Examiner*—Travis S. McGehee

*Attorney, Agent, or Firm*—Martin L. Faigus; William J. Foley

[57] ABSTRACT

A liquid impregnating system for impregnating, with a liquid, absorbent, compressible product maintained at least in part within the interior compartment of a tub or other container. The impregnating operation is carried out by compressing the product to increase the residence volume in the tub for the impregnating liquid, and directing the liquid into engagement with the product while it is maintained in its compressed condition. Most preferably, the product is a stack of absorbent sheets and the compressing operation is carried out by pressing downwardly on the uppermost sheet of the stack in localized areas intermediate end margins to cause end margins of at least some adjacent sheets in the stack to fan apart. This increases the accessibility of absorbent surface area within the stack to the impregnating liquid.

17 Claims, 12 Drawing Figures

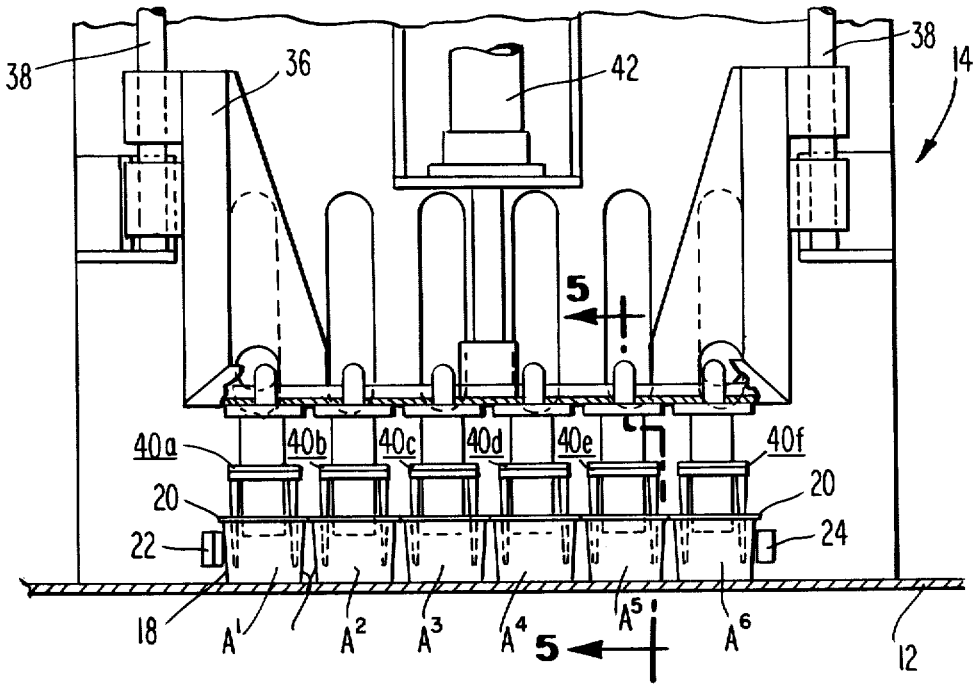
Fig. 4
Fig. 8
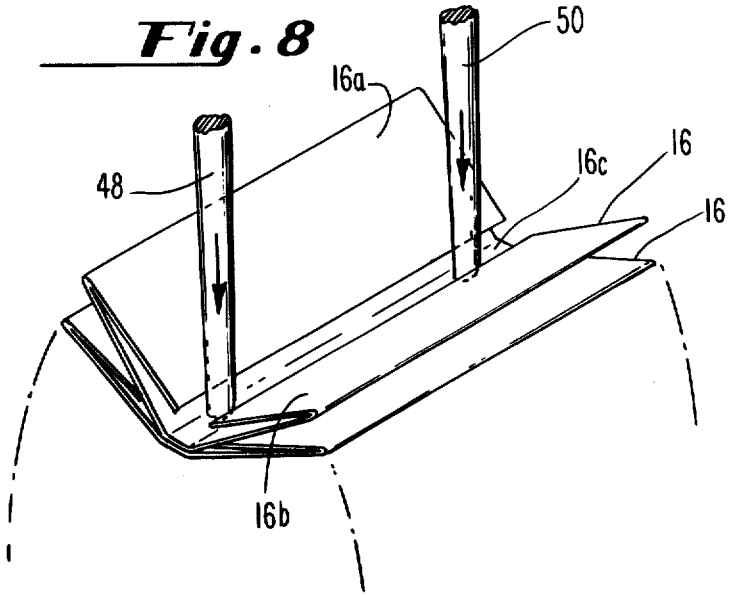

LIQUID IMPREGNATING SYSTEM

TECHNICAL FIELD

This invention relates generally to a liquid impregnating system, and in particular, to a system for impregnating absorbent, compressible product such as a stack of absorbent sheets.

BACKGROUND ART

A number of wiping products on the market consist of an absorbent fibrous web structure, or towelette, that is impregnated with a liquid to impart some desired attribute to its utility. For example, premoistened wipes employing cleansing lotions have become extremely popular for use in cleaning many portions of the human body; either to obtain a more thorough cleaning than can be achieved solely with a dry tissue, or for use under conditions where water, towels and the like are not readily available. One specific use for premoistened wipes is for cleaning excreta from the human anus, and usually after toilet paper has been used in the normal manner. In such an application the wiper is not a substitute for toilet paper but provides the final cleansing operation after the bulk of the excreta has been removed with the toilet paper. Impregnated wipes also are becoming extremely popular in the baby care field. Scott Paper Company, the assignee of this application, presently markets a baby wipe product under the trademark Baby Fresh.

Several prior art impregnated products, including the Baby Fresh product referred to above, are stacked and packaged in a sealed container. As part of the packaging operation the individual webs are folded, stacked and thereafter placed into a tub or similar container. It has been suggested to impregnate this product by spraying, printing or otherwise applying the additive onto a continuous web prior to cutting the web into discrete towelettes, or wipes, for subsequent folding and stacking into the container. Handling a wet web in the cutting, folding and stacking operations is usually a difficult, slow and inefficient process. In addition it is often more difficult to maintain sanitary conditions in a wet environment than in a dry environment. If equipment handling the wet web becomes contaminated, it can easily transmit the contaminants to the impregnated product. In a baby wipe product, for example, the contaminants can cause skin irritation and rashes.

In view of the above it should be appreciated that it is most desirable to cut, fold and stack the fibrous webs in a dry state, and thereafter add the liquid impregnating agent through a sanitary piping system. However, prior to this invention, there were several unsolved problems associated with such an impregnating technique. First a serious problem existed in introducing the impregnating liquid into the stack in a manner that completely saturated all of the sheets. This is a particularly significant problem when the individual sheets are of a low density, high bulk and highly absorbent construction of the type employed in the Baby Fresh product. Liquid applied to the upper sheet of such a stack tends to over saturate the top portion of the stack while leaving dry spots in the center portion of sheets in the interior of the stack. A second problem resides in providing sufficient residence volume within a tub containing the stack of webs so that the large volumes of liquid necessary to impregnate the stack can be introduced at a rapid rate into the tub, and thereafter be accommodated therein while the liquid is being absorbed into and through the stack.

It is also known in the art to add a liquid premoistening agent to individually packaged towelettes, as is evidenced by the patent to Clancy (U.S. Pat. No. 3,481,099) and Weinberger (U.S. Pat. No. 3,286,435). However, the techniques employed for impregnating individually packaged towelettes need not, and in fact do not deal with the problems associated with impregnating a stack of sheets.

DISCLOSURE OF INVENTION

In accordance with this invention a compressible product is positioned in the interior compartment of a tub, or other container, and is impregnated with a liquid while being maintained in a compressed condition. Most preferably the compressible product is a stack of absorbent sheets, and the compressive force is applied to the stack by pressing on the top sheet thereof in only a limited region in a manner to both reduce the height of the stack, and reduce the intimacy of contact between sections of at least some adjacent sheets of the stack. Reducing the stack height increases the liquid residence volume, white reducing the intimacy of contact between sections of some adjacent sheets increases the accessibility of absorbent surface area within the stack to the liquid. Most preferably the compressive force is applied in localized areas intermediate end margins of the stack. This not only compresses the stack but also deforms the stack to cause many of the adjacent sheets to fan apart adjacent end margins thereof. This increases the accessibility of absorbent surface area to the impregnating liquid to a greater extent than would be the case if the sheets were compressed without the "fanning" action.

Other objects and advantages of this invention will be apparent by referring to the following description of the best mode of this invention, taken in conjunction with the drawings.

BRIEF DESCRIPTION OF DRAWINGS

FIG. 4 is a front elevation view of the impregnating station of the system shown in FIG. 1, but with the liquid impregnating assembly in position to introduce the liquid into tubs containing absorbent product;

FIG. 8 is an isometric view illustrating the manner in which the sheets in the stack react to the compressive force applied by compression pins of the filling head assembly.

BEST MODE FOR CARRYING OUT THE INVENTION

Figure 1:
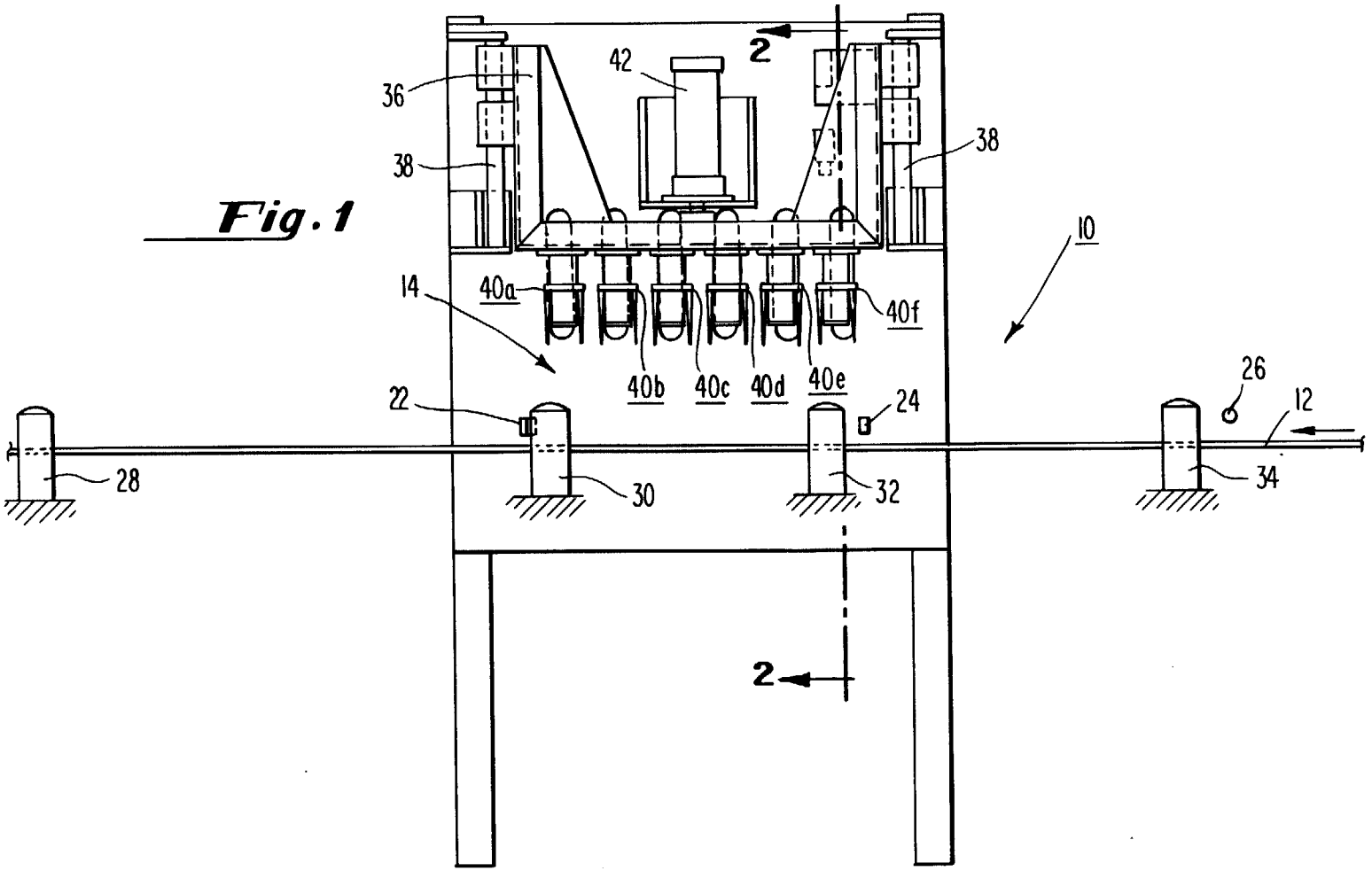
FIG. 1 is a schematic front elevation view of the liquid impregnating system of this invention.

Although specific terms are used in the following description for the sake of clarity, these terms are intended to refer only to the particular structure of the invention selected for illustration in the drawings, and are not intended to define or limit the scope of the invention.

Referring to FIGS. 1–4, the liquid impregnating system 10 of this invention includes a conveyor 12 for sequentially directing sets of tubs into a fill section 14. In the illustrated embodiment each set consists of six tubs, and, in FIG. 4 tubs $A^1$–$A^6$ are shown in the fill section 14.

Figure 6:
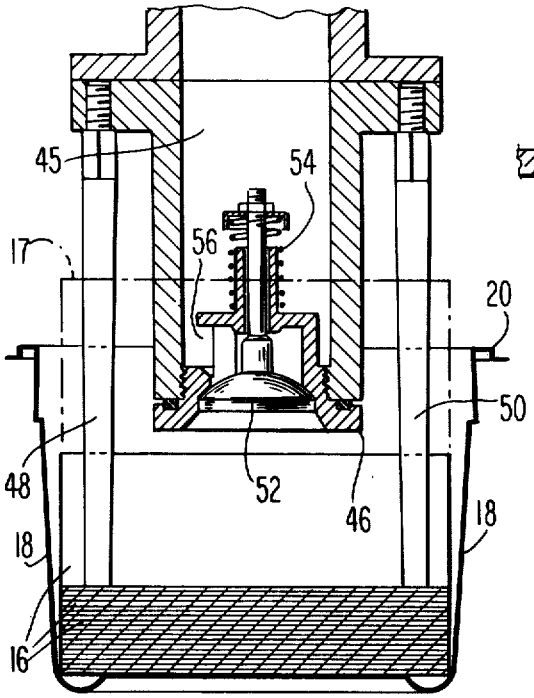
FIG. 6 is a sectional view taken along line 6—6 of FIG. 5.
Figure 5:
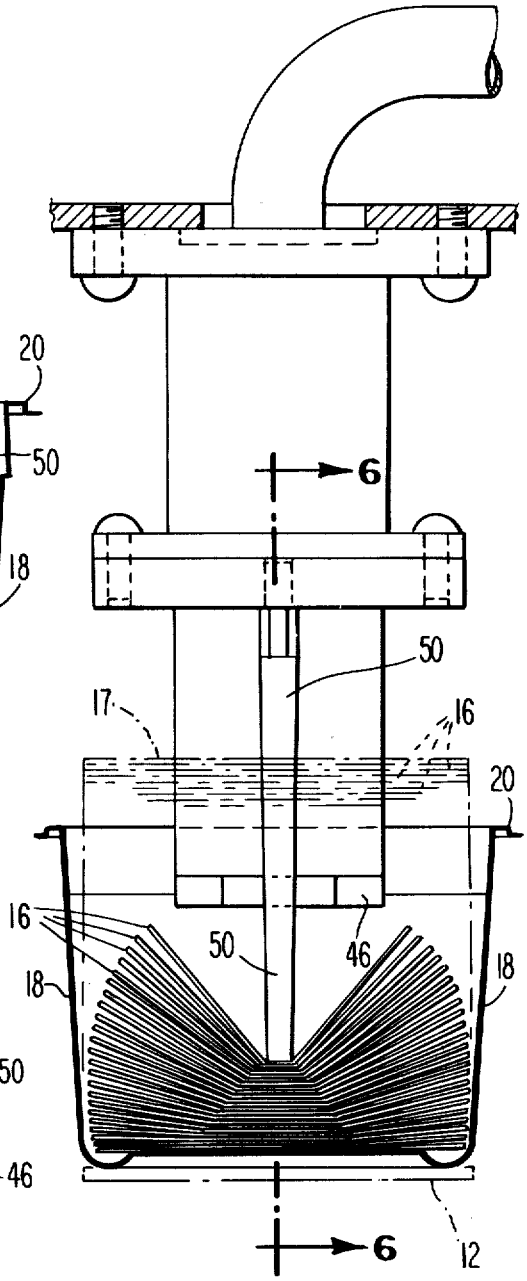
FIG. 5 is a sectional view taken along line 5—5 of FIG. 4.

Referring to FIGS. 5 and 6, each tub includes a stack of compressible fibrous web 16 to be impregnated with a liquid that imparts some desired attribute to its utility. For example, in the preferred embodiment of this invention the webs are impregnated with a medicated lotion to form premoistened cleansing cloths being sold by Scott Paper Company under the trademark Baby Fresh. In this product each fibrous web 16 is a high bulk, compressible air-lay structure formed predominately of wood pulp fibers, and including a minor proportion, by weight, of longer, textile reinforcing fibers (e.g. rayon, polyester, etc.). In the most preferred construction the web is embossed to enhance its strength and fluid-transmitting properties, and a suitable adhesive, such as an acrylic latex, is employed to bond the web into a coherent substrate suitable for use with the liquid impregnant. The webs 16, in their uncompressed state, are stacked to a height above the upper surface of the tub, as is shown in phantom representation at 17 in FIGS. 5 and 6. This is done to insure that substantially the entire tub volume will be filled by the wetted webs, after the webs have become somewhat compacted in the impregnating operation.

In the Baby Fresh product, as is illustrated herein, each tub has upwardly diverging peripheral walls 18 terminating in an outwardly directed rim 20 (FIGS. 4–6). The rim 20 cooperates with a snap-on lid (not shown) to form a closed package, as is more fully described in U.S. Pat. No. 3,904,074, assigned to Scott Paper Company, and herein incorporated by reference.

The particular construction of the fibrous webs 16 and the tubs in which said webs are stacked are not considered to be limitations on the broadest aspects of this invention. However, the most advantageous use of this invention is for completely impregnating a stack of compressible webs that are thick, bulky and highly absorbent.

Figure 3:
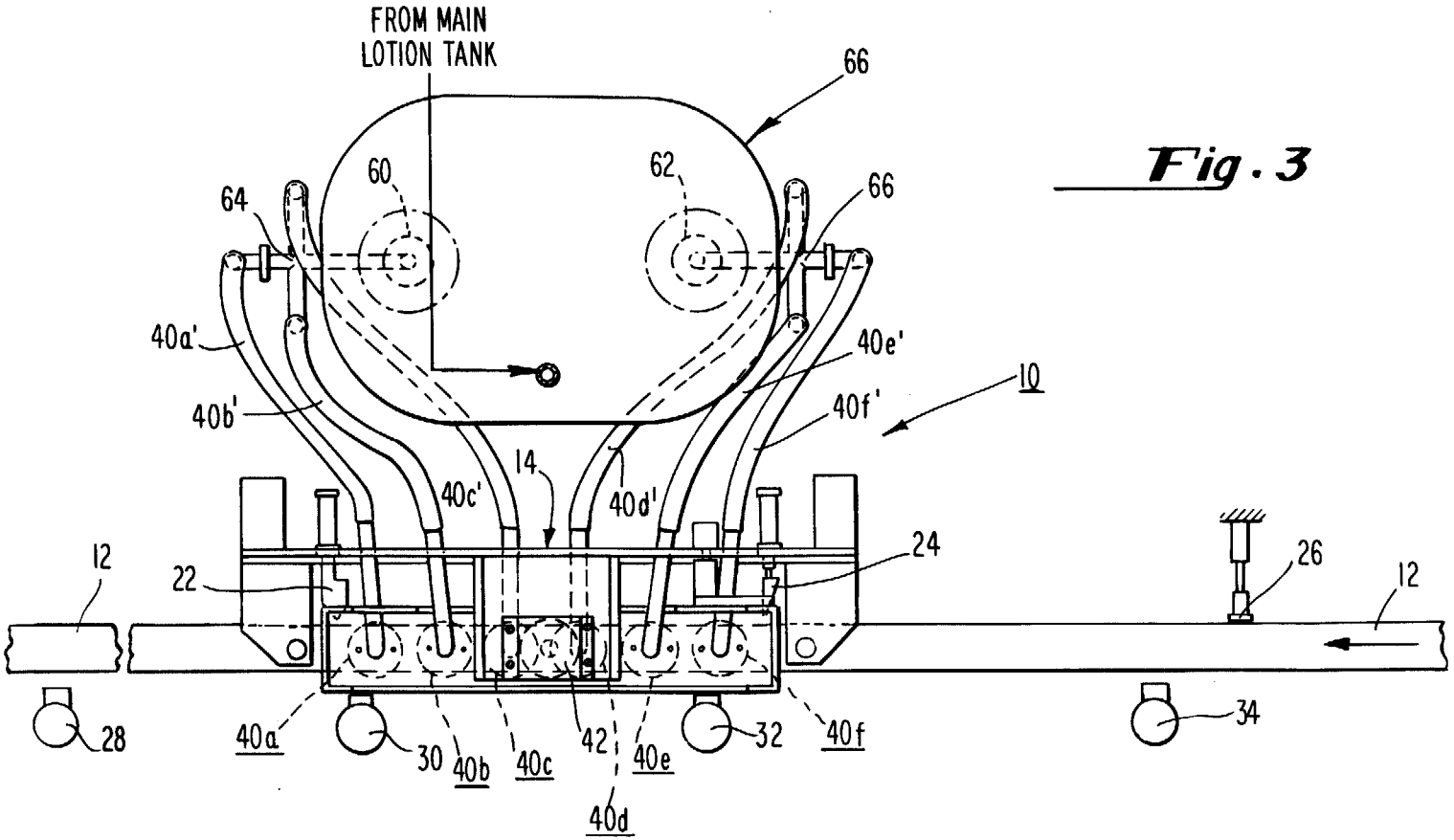
FIG. 3 is a plan view of the apparatus taken along line 3—3 of FIG. 2.
Figure 9:
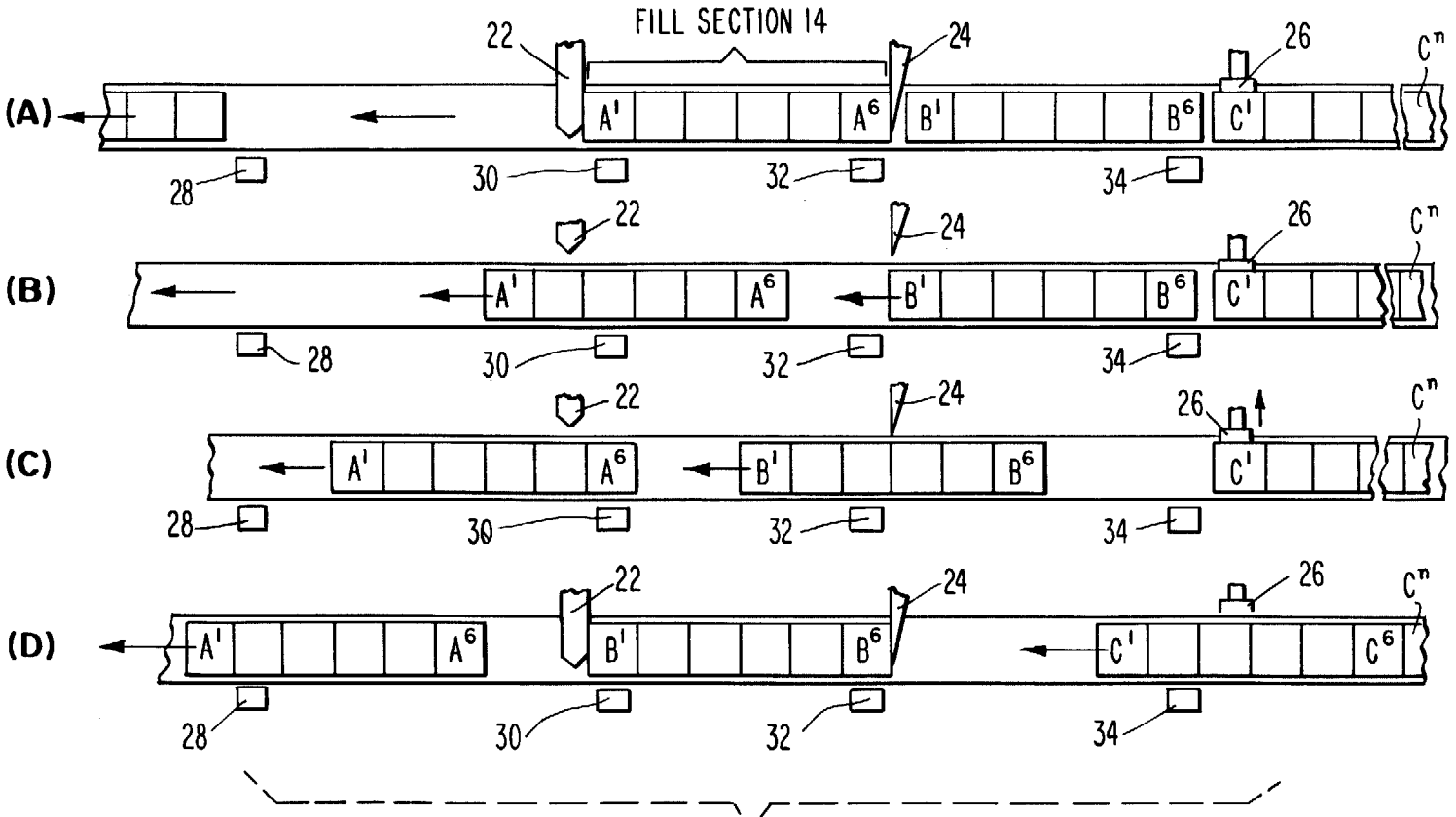
FIGS. 9 (A)-(D) illustrate different stages in the sequence of operations carried out by the system of this invention.

Referring specifically to FIGS. 3, 4 and 9, three pneumatically operated stops 22, 24, and 26 are spaced from each other, and are movable into the path of travel of the tubs on the conveyor 12. The stop 22, when in its extended position, engages a peripheral wall 18 of tub $A^1$ to retain the set of tubs $A^1$–$A^6$ in the fill section 14. The stop 24, when in its extended position, isolates the tubs $A^1$–$A^6$ in the fill section 14 from the next set of six tubs $B^1$–$B^6$ to be filled. The third stop 26, when in its extended position, holds back the remaining upstream tubs $C^1$–$C^n$ to assure that the tubs to be filled will be directed into the fill section 14 in groups of six. The operation of the stops 22, 24 and 26 is, at least in part, controlled by one or more of the photocells 28, 30, 32 and 34 (FIGS. 1, 3 and 9), in a manner to be subsequently described.

Referring specifically to FIGS. 1 and 4, the fill section 14 includes a carriage 36 mounted for reciprocation on guide rails 38. A set of six identical fill head assemblies 40*a*, 40*b*, 40*c*, 40*d*, 40*e* and 40*f* are secured to the carriage, and are operable to impregnate the stacks of product retained in the set of tubs $A^1$–$A^6$. The carriage 36 is operated to reciprocate between its inactive position (FIG. 1) and its active, or fill position (FIG. 4) by a suitable fluid-actuatable cylinder 42. A lotion, or other liquid will be directed through the fill head assemblies from a filler unit 44 (FIGS. 2 and 3) when the carriage is in its fill position.

Figure 7:
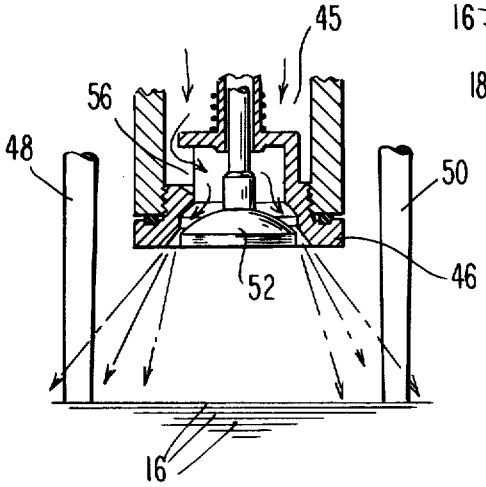
FIG. 7 is a fragmentary view of one filling head assembly in an opened condition for introducing impregnating liquid into a compartment of a container.

In view of the fact that all of the fill head assemblies are identical, their construction will be described in connection with the fill head assembly 40*e* shown in detail in FIGS. 5–7. Specifically, the fill head assembly 40*e* includes a central chamber 45 closed at its lower end by a valve assembly 46 that is normally spring loaded into a closed condition. The assembly also includes diametrically opposed compression pins 48 and 50 on opposite sides of the chamber 45 for compressing the product during the filling operation in a unique manner to be hereinafter described.

Figure 2:
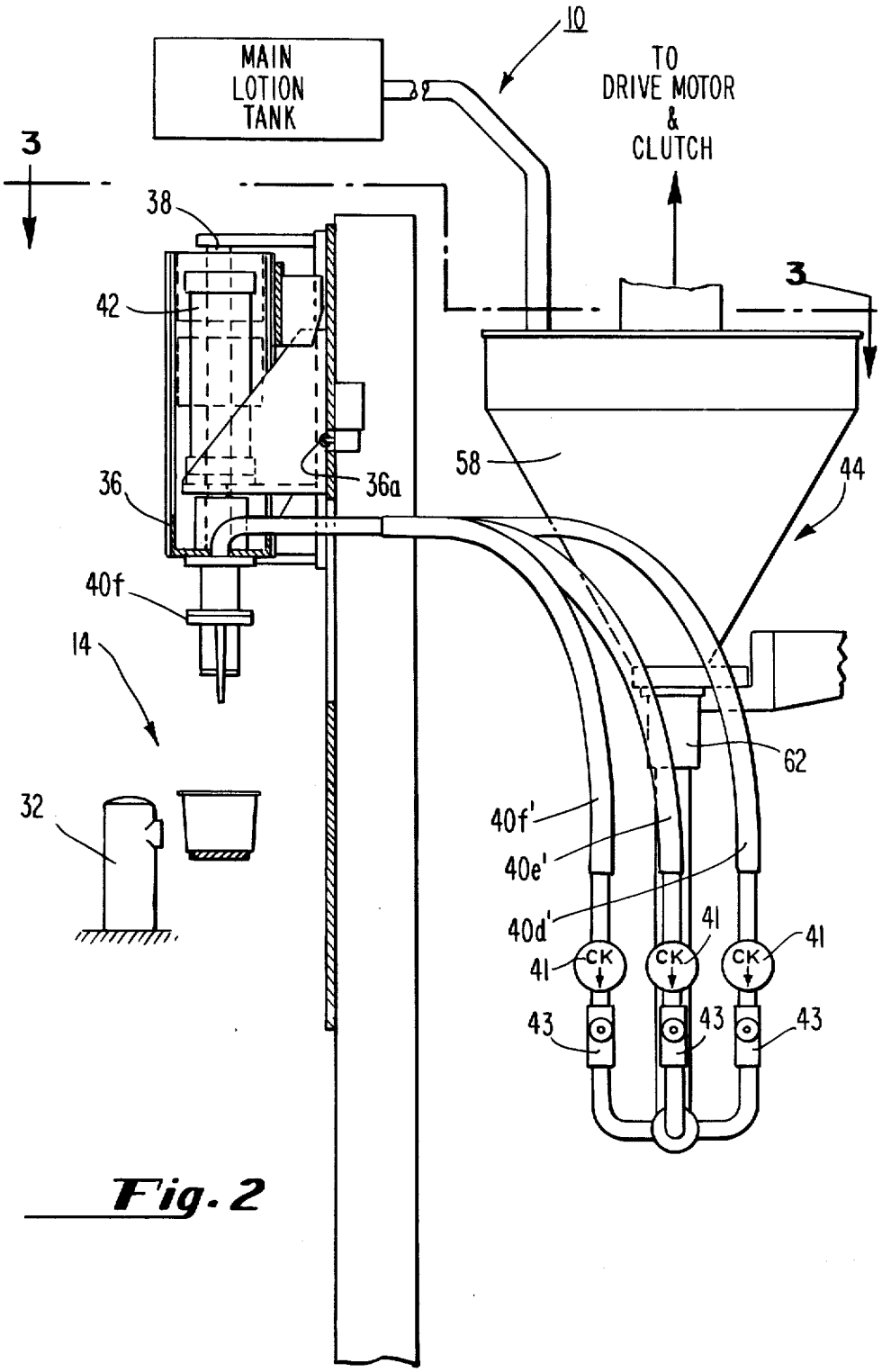
FIG. 2 is a sectional view taken along line 2—2 of FIG. 1, and showing a tub in position to receive an impregnating liquid.

The valve assembly 46 includes a poppet valve 52 normally retained in a closed condition against its valve seat by a coil spring 54, as is shown in FIG. 6. A passageway 56 is provided in a wall of the valve assembly 46 to communicate the valve assembly with the central chamber 45 through which the impregnating liquid is pumped from the filler unit 44 (FIGS. 2 and 3). The pressure imposed upon the poppet valve 52 by the pumped lotion will force it into an opened condition, and when this occurs, the impregnating liquid will flow through the valve assembly 46 to impregnate the stack of webs 16, as is shown in FIG. 7.

Referring specifically to FIGS. 2 and 3, the filler unit 44 is a Mateer Model 31-F dual auger filler sold by Mateer-Burt Co. of Wayne, Pa. This unit includes two motor driven positive displacement Moyno pumps 60 and 62 connected to a lotion feed hopper 58. The unit also includes an electronic system for controlling the volume of liquid directed to the fill head assemblies from the hopper 58 by each of the pumps 60 and 62. Specifically, the desired volume to be fed by each pump is set, in terms of the number of pump revolutions, on a digital counter. An encoder counts the completed revolutions of each pump, and when the set number is reached, the pumps are automatically deactivated to stop the flow of liquid to the fill head assemblies.

In order to direct liquid to the fill head assemblies suitable connections must be made between them and the pumps of the filler unit 44. In the illustrated embodiment the pump 62 communicates with a conduit 66 to feed the three fill head assemblies 40*d*, 40*e* and 40*f* through flexible tube connections 40*d*', 40*e*', and 40*f*' (FIGS. 2 and 3). A check valve 41 is included in each of the lines to isolate the valve assemblies 46 of respective fill head assemblies 40*d*'-*f*' from an excessively high liquid pressure head when the pump 62 is deactivated, or stopped. In this manner the respective valve assemblies 46 will close almost instantaneously when the pump 62 is stopped to aid in providing accurate volumetric control of the liquid pumped through the fill head assemblies 40*d*-*f*. In a like manner the pump 60 communicates with the conduit 64 to direct lotion into the three fill head assemblies 40*a*, 40*b* and 40*c* through flexible tube connections 40*a*', 40*b*' and 40*c*'. Also, a check valve (not shown), identical to check valves 41, is included in each line to provide the same function as the check valves 41. Although not shown, a separate conduit is provided to interconnect conduits 64 and 66, and this separate conduit includes a valve that can be opened if it becomes necessary to repair the drive to one of the pumps 60 or 62. Thus, when one of the pumps is not being utilized, the other pump is capable of feeding lotion to all six fill heads. Conventional flow control valves 43 are provided in each line to balance the flows to each of the fill head assemblies so that a substantially equal volume of liquid will be directed into each of the tubs in the fill section 14.

The level of the lotion in the feed tank 58 is maintained above a minimum level by pumping lotion into it from a main lotion tank, as is schematically represented in FIG. 2. If there is insufficient lotion in the feed tank 58 to introduce the appropriate quantity of lotion into each of the six tubs $A^1$–$A^6$, a low-level detector in the tank 58 will prevent actuation of the pumps 60 and 62. In a similar manner a high-level detector in the tank will shut off a pump (not shown) employed to direct lotion from the main lotion tank to the feed tank 58 when a predetermined level of liquid is present in the feed tank.

After the set of tubs $A^1$–$A^6$ are positioned in the fill section 14, the carriage 36 mounting the fill head assemblies 40*a–f* is lowered by the cylinder 42 to the position shown in FIG. 4. In this latter position the compression pins 48 and 50 will have engaged and compressed the stack of webs 16 in localized areas along a center-line of the stack to reduce the height of the stack, and thereby provide the necessary retention volume for lotion to be directed into the tubs. At this point the valve assemblies 46, through which the lotion is directed, are below the upper level of the tubs (FIGS. 4–6) to prevent, or minimize the escapage of lotion onto machine components during the fill cycle.

As can be seen best in FIGS. 5 and 8, compression of the stack of webs by the pins 48 and 50 also causes edge regions of many of the adjacent webs to separate from each other, or "fan," to permit the liquid pumped into the tubs to directly engage more absorbent surface area within the stack than would otherwise be the case if this fanning operation were not employed. This greatly increases the rate at which liquid is absorbed into the fibrous webs, and also aids in insuring that the individual webs throughout the stack are completely impregnated. Thus, the compression pins 48 and 50, in the preferred embodiment of this invention, both compress the stack and separate, or fan the sheets to provide the desired liquid residence volume and web surface area exposure to achieve the most desirable benefits of this invention. In fact, the system has been employed to direct a liquid having essentially the density of water into each tub at a rate of approximately 140 $cm^3$/sec.

After the desired volume of liquid has been introduced into the tubs, as determined by the encoder associated with the control of the positive displacement pumps 60 and 62, the pumps will be stopped, and this will automatically close the poppet valves 52 of the valve assemblies 46. Thereafter, the carriage 36 will be moved into its upper, inactive position by the cylinder 42. As the carriage 36 is moved upwardly the compression pins 48 and 50 will move out of engagement with the stack of compressed webs to permit the stack to expand, and thereby create a slight suction effect to aid in pulling unabsorbed liquid into the webs. However, the most significant contributor to impregnating all of the sheets in the stack is the separation that is achieved between successive sheets to expose a large surface area of the sheets to the impregnant.

Referring specifically to FIG. 8 each of the webs 16 is C-folded to include side panels 16*a* and 16*b* terminating in spaced relationship to each other to provide a single-thickness, center region 16*c* that is engaged by the pins 48 and 50. The difference in thickness between the center region 16*c* and the side regions formed by panels 16*a* and 16*b* aids in causing the sheets to deform and the side edges to fan-apart when the stack is subjected to the compressive force along its center line. Although the C-folded arrangement shown in FIG. 8 is acceptable it is not considered to be a limitation on the broadest aspects of this invention. However, regardless of the fold, it is most desirable to form fewer plies in the center of each web than at the ends.

Referring specifically to FIG. 9, the manner in which the system 10 is automatically controlled will be described in connection with one complete cycle of operation. In describing this operation the beginning of the cycle will be considered to be the point at which the stacks of fibrous webs in the tubs $A^1$–$A^6$ have just been filled with a lotion, the conveyor 12 is stopped and the carriage 36 is in its lowermost position shown in FIG. 4. After the tubs have been filled, the cylinder 42 automatically will be actuated to raise the carriage 36 and the conveyor 12 will be started. However, if previously filled tubs have backed up to intercept the photocell 28, indicating that there is insufficient room for receiving the newly filled tubs $A^1$–$A^6$ from the fill section 14, the stop 22 will remain in the path of tub travel to prevent the newly filled tubs from leaving the fill section. When the previously filled downstream tubs have moved passed the photocell 28, as shown in FIG. 9A, and if the photocell 34 detects the presense of tub $B^6$, thereby indicating that a full compliment of six tubs is available for introduction into the fill section 14, then the reciprocating stop 22 automatically will be retracted to permit movement of the tubs $A^1$–$A^6$ out of the fill section 14. After a preset time delay the stop 24 also will automatically be retracted to permit the tubs $B^1$–$B^6$ to move into the fill section 14. By retracting the stop 24 a preset time after stop 22, a gap, or window, will be provided between the set of filled tubs $A^1$–$A^6$ leaving the fill section 14, and the set of tubs $B^1$–$B^6$ entering the fill section, as is shown best in FIG. 9B. The purpose of establishing this gap will be explained later.

It should be pointed out that if the photocell 34 does not detect the presence of the tub $B^6$, the stops 22 and 24 will not be retracted after the fill cycle, and therefore the tubs $A^1$–$A^6$ will remain in the fill section 14. However, as long as the photocell 34 does detect the existence of the tub $B^6$, the third stop 26 will remain in it its extended position engaging a sidewall of container $C^1$ to prevent motion of the upstream tubs $C^1$–$C^n$ (FIGS. 9A and 9B).

If the photocell 34 detects the presence of the tub $B^6$, thereby indicating that a full compliment of six tubs $B^1$–$B^6$ is available for a subsequent filling operation, the stops 22 and 24 will be retracted as described above (FIG. 9B), and the tubs $A^1$–$A^6$, as they move out of the fill section 14, will be counted by the photocell 30 and its associated counter (not shown). As the tubs $B^1$–$B^6$ begin moving into the fill section the tub $B^6$ will be moved out of its position intercepting the photocell 34. After the photocell 34 has failed to detect the presence of a tub for a continuous preset time period built into the circuit, the third stop 26 will be retracted to permit tubs $C^1$–$C^n$ to begin moving, but with a gap between the tubs $B^6$ and $C^1$ as is best illustrated in FIGS. 9C and 9D.

After the tub $A^6$ passes the photocell 30, the reciprocating stop 22 will be extended across the path of the conveyor 12 to subsequently engage the container $B^1$. To accomplish this result it is important that the space provided between the tub $A^6$ and the tub $B^1$ be sufficiently large to receive the stop 22 in it after the photocell 30 has detected the passage of the sixth tub (e.g. $A^6$).

The photocell 32 is part of a time delay circuit that actuates the second reciprocating stop 24 to cause it to move across the path of the conveyor 12 only if it continuously detects the presence of a tub for a preset time period that is longer than the time period that each tub is in front of the photocell when the tubs are moving. Since upwardly diverging peripheral walls 18 of adjacent tubs are spaced from each other (See FIG. 4), the photocell 32 will "see" the gaps between the moving tubs before it continuously "sees" a tub for a long enough period of time to complete the circuit that extends the reciprocating stop 24 into the path of travel of the tubs. However, once the tub $B^6$ comes to rest in front of the photocell 32, as a result of the stop 22 engaging the tub $B^1$, and this rest condition is detected for the preset period of time, the stop 24 will be moved across the path of the conveyor 12 in the space, or "window," provided between the tub $B^6$ and the tub $C^1$ (FIG. 9D).

At this point in the operation the tub $C^1$ will be moved into engagement with the stop 24 to occupy the position previously occupied by the tub $B^1$ in FIG. 9A. Likewise, the tub $C^6$ will move into the position previously occupied by the tub $B^6$ in FIG. 9A, and will therefore intercept the photocell 34. The photocell 34, similar to photocell 32, is part of a time delay circuit that will extend the stop 26 into engagement with a sidewall of a tub occupying the position of tub $C^1$ in FIG. 9A only after it has continuously detected the presence of the tub $C^6$ for a preset period of time that is greater than the period of time a tub continuously intercepts the photocell when it is moving toward the stop 24. Therefore, the stop 26 will only be fired into engagement with a tub sidewall after a full compliment of tubs $C^1$–$C^6$ has come to rest in the position previously occupied by tubs $B^1$–$B^6$ in FIG. 9A. Once a full compliment of tubs is positioned in the zone adjacent the fill section 14, the photocell 34 will continuously detect the presence of tub $C^6$ for the requisite time to actuate the stop 26 to move it into engagement with the tub $C^7$ occupying the position previously occupied by the tub $C^1$ in FIG. 9A.

At this point in the operation the cylinder 42 is operated to lower the carriage 36 to the position shown in FIG. 4 for the purpose of commencing the filling operation. Movement of the carriage into its lower position actuates a microswitch 36*a* (FIG. 2) to stop the conveyor 12, and to activate the positive displacement pumps 60 and 62 for automatically forcing the impregnating liquid through the various fill head assemblies 40*a*–40*f* into the tubs $B^1$–$B^6$. After the preset quantity of liquid is directed by the pumps 60 and 62 into the tubs $B^1$–$B^6$, the pumps will be automatically deactivated, and the sequence of operations repeated.

From the above discussion it should be apparent that the system 10 is designed to be virtually fail-safe. That is, it will automatically shut down if there is insufficient room for the filled tubs to be removed from the fill section 14, and/or if a full compliment of tubs is not available to be subsequently directed into the fill section. Moreover, the stops 22, 24 and 26 are operated to establish sufficient gaps, or spaces between the set of filled tubs (e.g. $A^1$–$A^6$) and the next set of tubs to be filled (e.g. $B^1$–$B^6$), and also between the latter-mentioned set of tubs and a continuous line of upstream tubs (e.g. $C^1$–$C^n$), to prevent the stops 22 and 24 from piercing or otherwise damaging the tubs when they are moved across the path of the conveyor 12; regardless of whether the upper rims 20 of these tubs (FIGS. 4–5) abut or overlap each other. This is important when the tubs include rims adjacent their upper surfaces since the overall space occupied by each set of six tubs can vary depending upon whether all of the rims abut each other, whether they overlap each other or whether combinations of abutting and overlapping conditions exist. The spacings established in this invention are sufficiently large to accommodate these different conditions without the stops 22 or 24 piercing, or otherwise damaging the tubs.

Although the invention has been described with a certain degree of particularity, it is understood that the present disclosure has been made only by way of example, and that numerous changes in the details of construction and the combination and arrangement of parts may be resorted to without departing from the scope of the invention.

What is claimed as the invention is:

1. A method of introducing a liquid into absorbent sheets that are maintained in a stacked condition with at least a portion of the stack positioned within the interior of a container, said method including the steps of:
   (a) applying a compressive force to only a limited region of the upper sheet of the stack in a manner to both reduce the height of said stack and reduce the intimacy of contact between sections of at least some adjacent sheets of said stack; and
   (b) directing a liquid into engagement with the sheets while maintaining said compressive force.

2. The method of claim 1 wherein the step of applying the compressive force is achieved by engaging the upper sheet of the stack inwardly of end margins.

3. The method of claim 2 wherein the limited region to which the compressive force is applied is along a medial line of the stack.

4. The method of claim 3 including folding the sheets in the stack so that the medial region of the sheets has fewer plies than side regions of said sheets, said compressive force being applied solely in the medial region to cause the side regions of at least some adjacent sheets to at least partially separate from each other.

5. A method of introducing a liquid into absorbent sheets that are maintained in a stacked condition with at least a portion of the stack positioned within the interior of a container, said method including the steps of:
   (a) compressing the stack of sheets inwardly of side margins thereof;
   (b) flaring apart side margins of at least some adjacent sheets of the stack; and
   (c) directing a liquid into engagement with the sheets when the stack is compressed and the side margins of said at least some adjacent sheets are flared.

6. In a method of forming a package of liquid-impregnated absorbent sheets;
   (a) positioning a stack of absorbent sheets in the interior compartment of a tub with the upper sheet of the stack extending above the upper surface of the compartment;

(b) compressing the stack of sheets so that at least a portion of the upper sheet of the stack is positioned below the upper surface of the compartment, and, while said stack is so compressed;

(c) introducing the liquid into engagement with at least the portion of the upper sheet that is positioned below the upper surface of the compartment.

7. The method of claim 6 wherein the compressing step is carrried out by pressing on only localized areas of the stack to both reduce the height of said stack and reduce the intimacy of contact between sections of at least some adjacent sheets of said stack.

8. The method of claim 7, wherein the pressing is in localized areas of the stack intermediate end margins thereof to cause end margins of at least some adjacent sheets of the stack to fan apart.

9. The method of claim 8 wherein the localized areas are spaced apart points, and the step of introducing the liquid into engagement with the sheets is carried out by directing the liquid onto the upper surface of the stack between the spaced apart points.

10. A liquid impregnating system for use in impregnating absorbent, compressible product maintained at least partially within the interior compartment of a container, said impregnating system comprising:

(a) a chamber through which liquid can be directed into the interior compartment of the container;

(b) pressure means adapted to engage and compress the product within the compartment;

(c) movable means mounting said chamber and pressure means;

(d) actuating means for moving the chamber and pressure means from a first position above the upper surface of the container to a second position wherein the pressure means engages and compresses the product therein; and (e) liquid feeding means for directing the liquid through the chamber when the product is compressed.

11. The system of claim 10, wherein the chamber and pressure means are interconnected to provide a fill head assembly that is moved as a single unit by said actuating means .

12. The system of claim 10 wherein a normally closed valve communicates with the chamber, said valve being movable to an open position by liquid under pressure, said liquid feeding means being operable for introducing the liquid into the chamber under pressure when the pressure means engages and compresses the product.

13. The system of claim 11 where the pressure means of the fill head assembly includes pressure members spaced diametrically from each other on opposite sides of the chamber through which the liquid can be directed.

14. The system of claim 11 wherein the fill section includes a plurality of said fill head assemblies for introducing liquid into the interior compartment of a plurality of aligned containers.

15. The system of claim 14 including a conveyor for directing a plurality of containers into the fill section into alignment with respective fill head assemblies.

16. The system of claim 15 including conveyor control means for maintaining the conveyor in a stopped condition when the plurality of fill head assemblies are in their second position.

17. An apparatus for introducing a liquid into absorbent sheets that are maintained in a stacked condition with at least a portion of the stack positioned within the interior of a container, said apparatus including:

(a) means for applying a compressive force to only a limited region of the upper sheet of the stack in a manner to both reduce the height of said stack and reduce the intimacy of contact between sections of at least some adjacent sheets of said stack; and (b) means for directing a liquid into engagement with the sheets while said compressive force is being maintained.

* * * * *